US008882022B2

(12) United States Patent
Wierstra

(10) Patent No.: US 8,882,022 B2
(45) Date of Patent: Nov. 11, 2014

(54) SPOOL AND HANDLE FOR CABLE AND WIRE

(75) Inventor: Sidney Wierstra, Ontario (CA)

(73) Assignee: Nexans, Paris (FR)

( * ) Notice: Subject to any disclaimer, the term of this patent is extended or adjusted under 35 U.S.C. 154(b) by 589 days.

(21) Appl. No.: 13/077,155

(22) Filed: Mar. 31, 2011

(65) Prior Publication Data

US 2012/0248232 A1 Oct. 4, 2012

(51) Int. Cl.
*B65H 75/14* (2006.01)
*B65H 75/18* (2006.01)

(52) U.S. Cl.
CPC ..... *B65H 75/14* (2013.01); *B65H 2701/5122* (2013.01); *B65H 2402/412* (2013.01)
USPC ..... 242/588.2; 242/614; 242/118.4; 242/129

(58) Field of Classification Search
USPC ..... 242/405–405.3, 588, 588.2, 600, 614, 242/129, 118.4; 294/15, 158, 169; 16/110.1, 422, 423, 425, 426, DIG. 15, 16/DIG. 24
See application file for complete search history.

(56) References Cited

U.S. PATENT DOCUMENTS

| | | | | | |
|---|---|---|---|---|---|
| 1,108,855 | A | * | 8/1914 | Simmons | 242/600 |
| 3,533,541 | A | * | 10/1970 | Lerner et al. | 206/565 |
| 3,778,002 | A | * | 12/1973 | Alleweireldt | 242/129 |
| 4,253,569 | A | * | 3/1981 | O'Connor et al. | 206/391 |
| 4,253,570 | A | * | 3/1981 | O'Connor et al. | 206/391 |
| 4,493,462 | A | * | 1/1985 | Ditton | 242/118.61 |
| 4,741,492 | A | * | 5/1988 | Reysen | 242/129 |

* cited by examiner

*Primary Examiner* — William E Dondero
(74) *Attorney, Agent, or Firm* — Sofer & Haroun, LLP

(57) ABSTRACT

A cable carrying assembly includes a spool made from a first flange region, drum portion and a second flange region where each of the first flange region, drum portion and a second flange region are integrally molded as a single polymer unit. The drum portion is molded as a hollow drum for supporting a cable. The first flange region includes at least two openings and a handle receiving region and the handle has a grip portion, two stems each with a latch knob. The stems and knobs of the handle are inserted into the at least two openings on the first flange region of the drum and lock into place via the knobs, such that the grip portion of the handle is arrangeable in a first open position with the grip portion substantially perpendicular to the first flange regions and a second closed position with the grip portion folded down about the articulated joints, into the handle receiving region of the first flange region.

2 Claims, 7 Drawing Sheets

SPOOL AND HANDLE FOR CABLE AND WIRE

BACKGROUND

1. Field of the Invention

This application relates to spools. More particularly, the application relates to spools for wire and cable.

2. Description of Related Art

It is generally desirable to produce a wire/cable spool that is sturdy, easy to assemble and of reasonable cost. Metal spools have been used in the past but there are many problems associated with such structures.

For example, metal spools add significantly to the cost of production. Another drawback associated with prior art metal spools is that, because of the cable winding machinery, the metal spool handle has to be inserted into the spool after the cable has been wound onto thereon, thus reducing packaging efficiency. For example, the packaging operator has to insert approximately one handle every thirty seconds on one of the packaging lines and this is repetitive and monotonous to perform for extended times. The operator's well being and safety are a concern.

Other prior art cable packaging uses plastic spools. However, the existing prior art plastic spool designs have several flaws. Owing to the construction of the spools, the flanges and/or drums often break due to handling.

Additionally, existing plastic spools are usually made in three steps; the molding of the two flanges, the molding of the drum/barrel, then assembly (by heat welding, press gluing etc. . . . ) of the three components. This process is time consuming and if done ineffectively results in weak joints and thus weak spools.

OBJECTS AND SUMMARY

The present arrangement overcomes the drawbacks associated with the prior art and provides a plastic cable spool that is both more robust as well as easier to assemble. The present structure involves fewer manufacturing steps and also provides a better handle design that is easier to assemble, and also compatible with existing cable spool winding equipment.

To this end, a cable carrying assembly includes a spool made from a first flange region, drum portion and a second flange region where each of the first flange region, drum portion and a second flange region are integrally molded as a single polymer unit. The drum portion is molded as a hollow drum for supporting a cable.

The first flange region includes at least two openings and a handle receiving region and the handle has a grip portion, two stems each with a latch knob. The stems and knobs of the handle are inserted into the at least two openings on the first flange region of the drum and lock into place via the knobs, such that the grip portion of the handle is arrangeable in a first open position with the grip portion substantially perpendicular to the first flange regions and a second closed position with the grip portion folded down about the articulated joints, into the handle receiving region of the first flange region.

BRIEF DESCRIPTION OF THE DRAWINGS

The present invention can be understood through the following description and accompanying drawings, wherein.

DETAILED DESCRIPTION

In one embodiment of the present arrangement a spool 100 is provided for holding wound cable or wire, including but not limited to power cable and telecommunications cables and wires. Spool 100 is shown in FIG. 1, with the following sections of the specification describing the details of its components.

Figure 1:
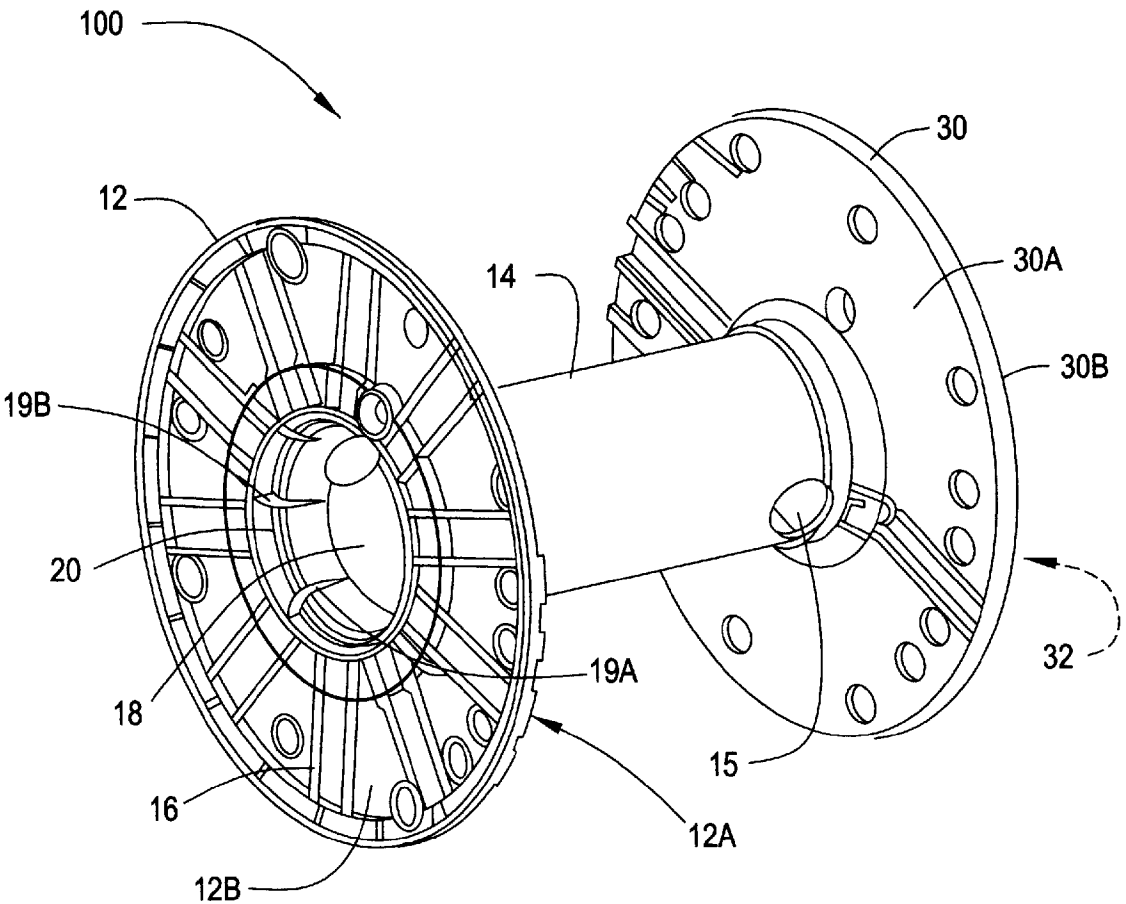
FIG. 1 is a perspective view of a plastic spool in accordance with one embodiment.

As shown in FIG. 1 spool 100 is provided with a first flange region 12 and a drum region 14. In one arrangement, both first flange region 12 and drum region 14 of first spool element 10 are molded as single unitary item so that there is a seamless connection between the two regions.

As shown in FIG. 1, first flange region 12 has an inner surface 12*a* that faces towards drum region 14 and is substantially smooth, to facilitate the easy winding and removal of the cable from drum region 14. First flange region 12*a* also has an outer surface 12*b* which faces away from drum region 14 and includes many strength spines 16 for giving first flange region 12 structural strength for supporting the weight of the cable.

In the center of outer surface 12*b*, there is an opening 18 that allows for spool 100 to eventually be mounted onto an axel of a payoff-dispenser. First flange region 12 also includes two holes 19*a* and 19*b* dimensioned to allow a handle 50, described in more detail below, to be inserted during or after the manufacture of spool 100. In the region of opening 18 of outer surface 12*b* of first flange region 12, grip receiving area 20 is configured to provide a region for receiving a folded gripping portion of a handle 50, also discussed in more detail below.

Drum region 14 of spool 100 preferably has a hollow cylindrical profile as shown in FIG. 1, however other shapes are possible depending on the requirements needed for the cable to be wound on spool 100. In order to reduce the weight of spool 100, openings 15 may be placed along drum 15 to reduce the total amount of polymer used for spool 100.

Figure 2:
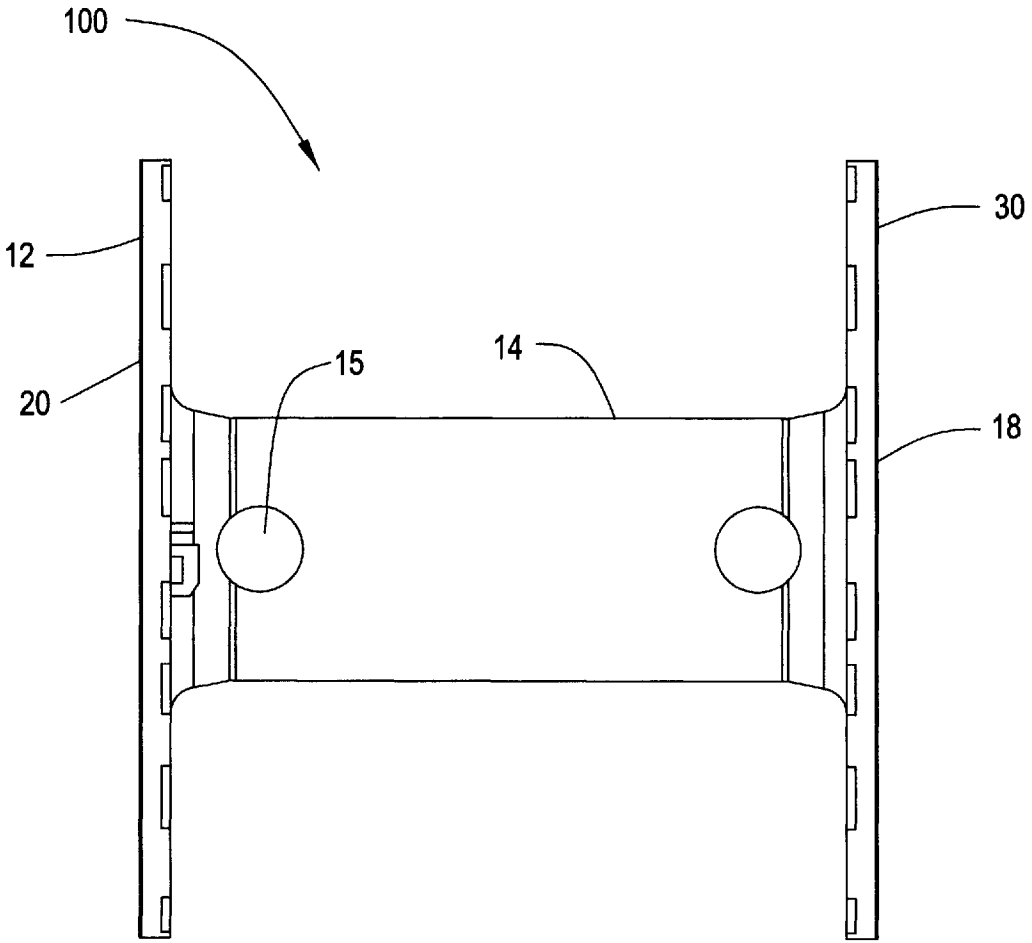
FIG. 2 is a side view of the plastic spool of FIG. 1, in accordance with one embodiment.

Also shown in FIGS. 1 and 2, spool 100 has a continuous second end flange region 30. As with flange region 12 of first spool element 10, second flange region 30 has a smooth inner surface 30*a* and an outer surface 30*b* with strength spines 32 similar to first flange region 12. Each of first flange region 12, drum 14 and second end flange 30 are all formed a single integral unit so that it is cable of handling the winding an unwinding stress of the cable.

It is noted that the dimensions of first flange region 10 and second flange region 30 may be any desired size to create a spool 100, depending on the desired length and weight of the cable to be spooled thereon. The present arrangement is not limited in this respect. Additionally, the components of first spool flange region 12 and second flange region 30 are preferably made of HDPE (High Density PolyEthylene), however other polymers may be used.

Figure 3A:
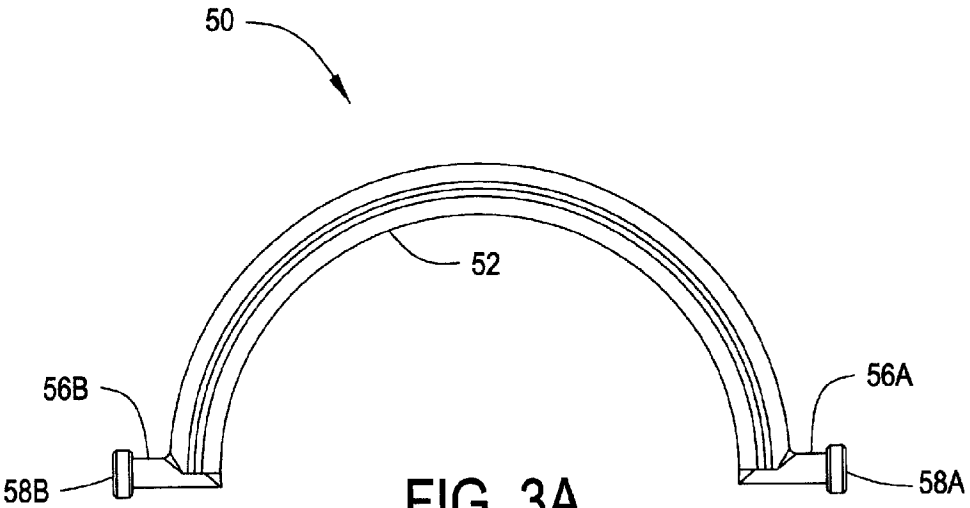
FIGS. 3A-3C show a handle for the spool of FIGS. 1 and 2, in accordance with one embodiment.
Figure 3B:
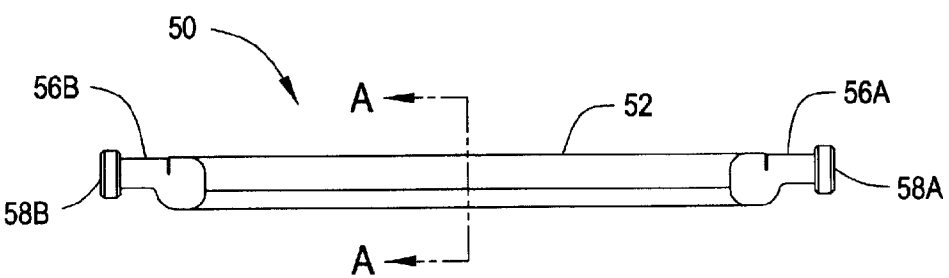
Figure 3C:
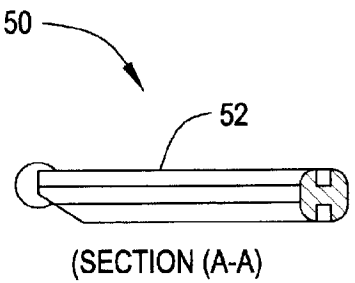

Turning now to FIGS. 3A-3B, a handle 50 is shown having a grip region 52, and support stems 56*a* and 56*b*. It is noted that handle 50 may have certain modifications or shape changes to grip portion 52 and support stems 56*a*, 56*b*, depending on the size and dimensions of spool 100. At the bottom of support stems 56*a*, 56*b*, are snapping knobs 58*a* and 58*b* respectively. These knobs 58*a* and 58*b* are configured to fit into corresponding openings 19*a* and 19*b* on first flange region 12 of spool 100 near drum 14 and opening 20 as discussed in more detail below.

Figure 4A:
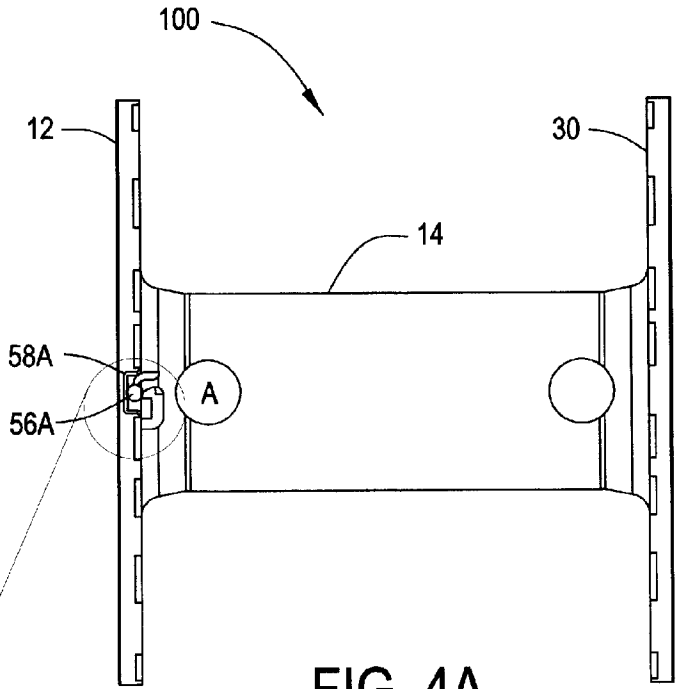
FIGS. 4A-4C show the articulated hinge of FIG. 3 inserted into the spool of FIG. 1, in a down position, in accordance with one embodiment.
Figure 4B:
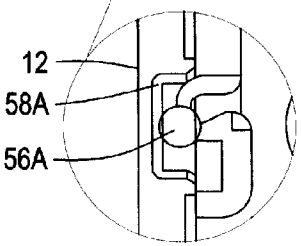
Figure 4C:
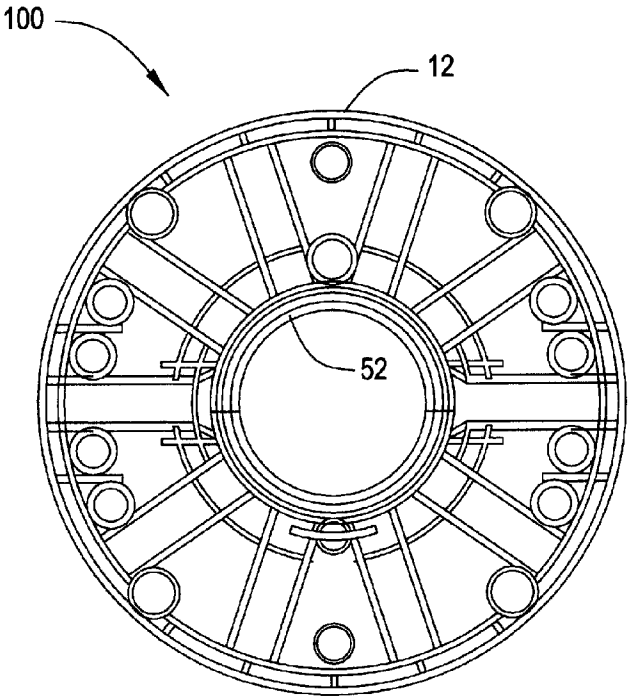

When assembling spool 100, as shown in FIGS. 4A-4C, support stems 56*a*, 56*b* and knobs 58*a* and 58*b* are placed into the openings 19*a* and 19*b* in first flange region 12 until they click into place. FIG. 4B is a close up view of FIG. 4A, showing handle 50 inserted into first flange region 12. In FIG. 4C, portion 52 of handle 50 is folded down into receiving area 20 of flange region 12 as stems 56*a*, 56*b* and knobs 58*a* and 58*b* allow grip portion 52 to swing down into a flat arrangement against flange 12. This allows for easy storage of spools 100 and also is useful when inserting spools 100 into the necessary winding machines for placing cable 102 onto spools 100.

Figure 5A:
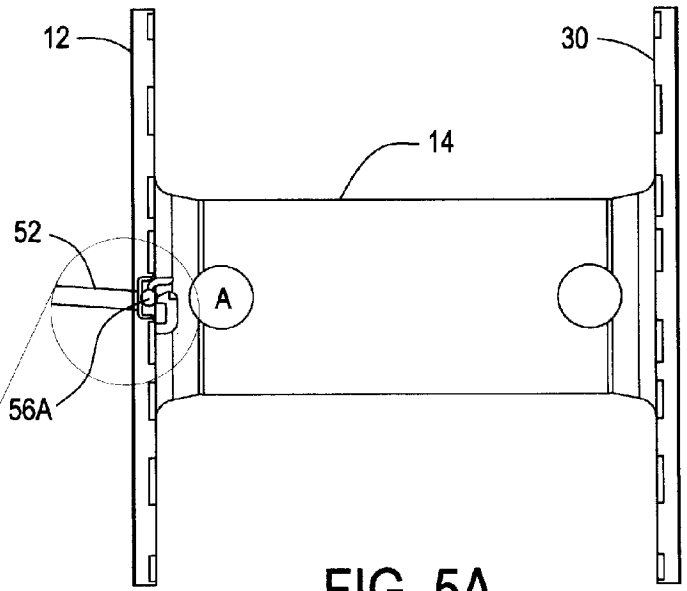
FIGS. 5A-5C show the articulated hinge of FIG. 3 inserted into the spool of FIG. 1, in an up position, in accordance with one embodiment.
Figure 5B:
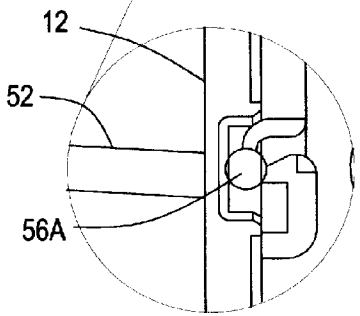
Figure 5C:
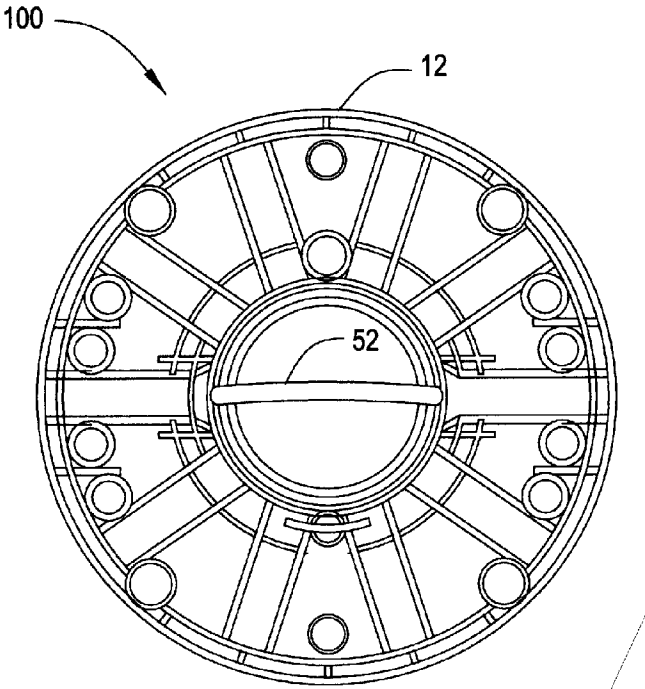

FIGS. 5A-5C are essentially, the same as FIGS. 4A-4C, only, grip portion 52 of handle 50 is folded up away from outer surface 12*a* of first flange region 12 so that a user may grip and carry spool 100. If desired, it is noted that handle 50 may actually be removed from spool 100 by simply pressing or otherwise manipulating knobs 58*a* and 58*b* out of openings 19*a* and 19*b* as folding and twisting as necessary, as per FIGS. 4B and 5B.

Figure 6A:
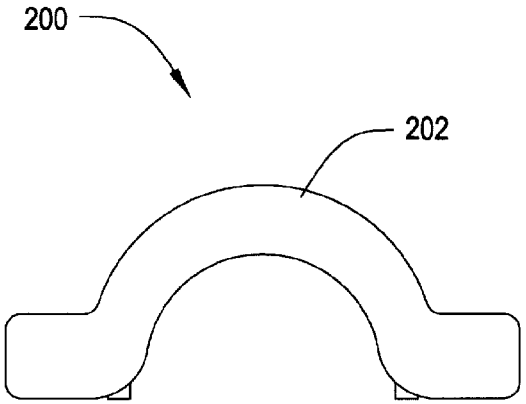
FIGS. 6A-6B show an alternative handle for the spool of FIGS. 1 and 2, in accordance with one embodiment.
Figure 6B:
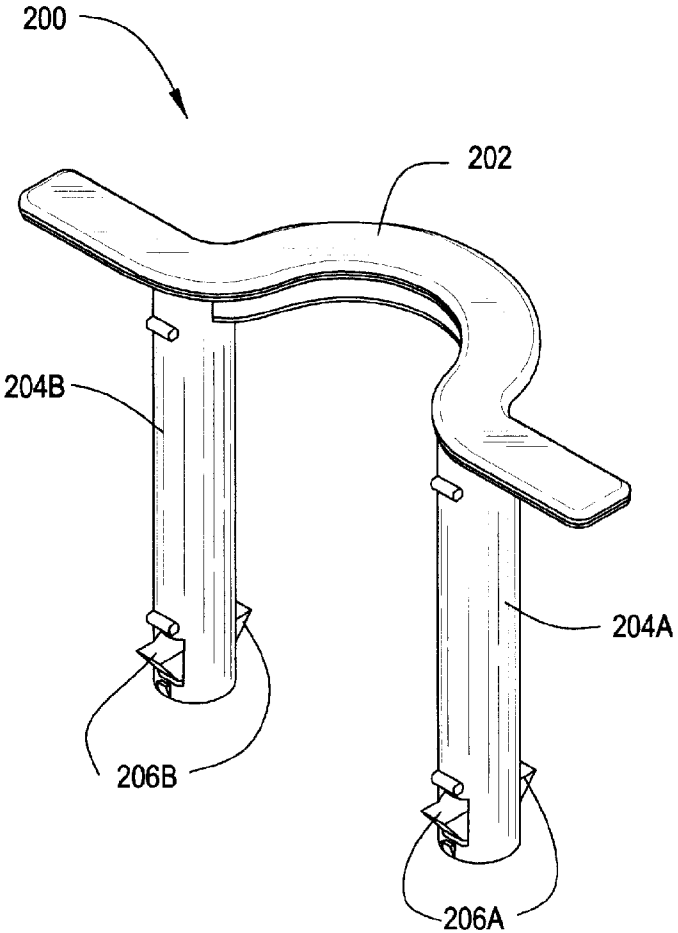

Turning now to FIGS. 6A and 6B, it is noted that an alternative handle 200 may be employed. Handle 200 has a grip portion 202, two stems 204*a* and 204*b*, each with clip latches 206*a* and 206*b* respectively. Unlike handle 50, this handle 200 does not clip into openings 19*a* and 19*b* in a pivoting arrangement. Rather, handle 200 is inserted into holes 210*a* and 210*b* respectively on first flange region 12 of spool 100.

Figure 7:
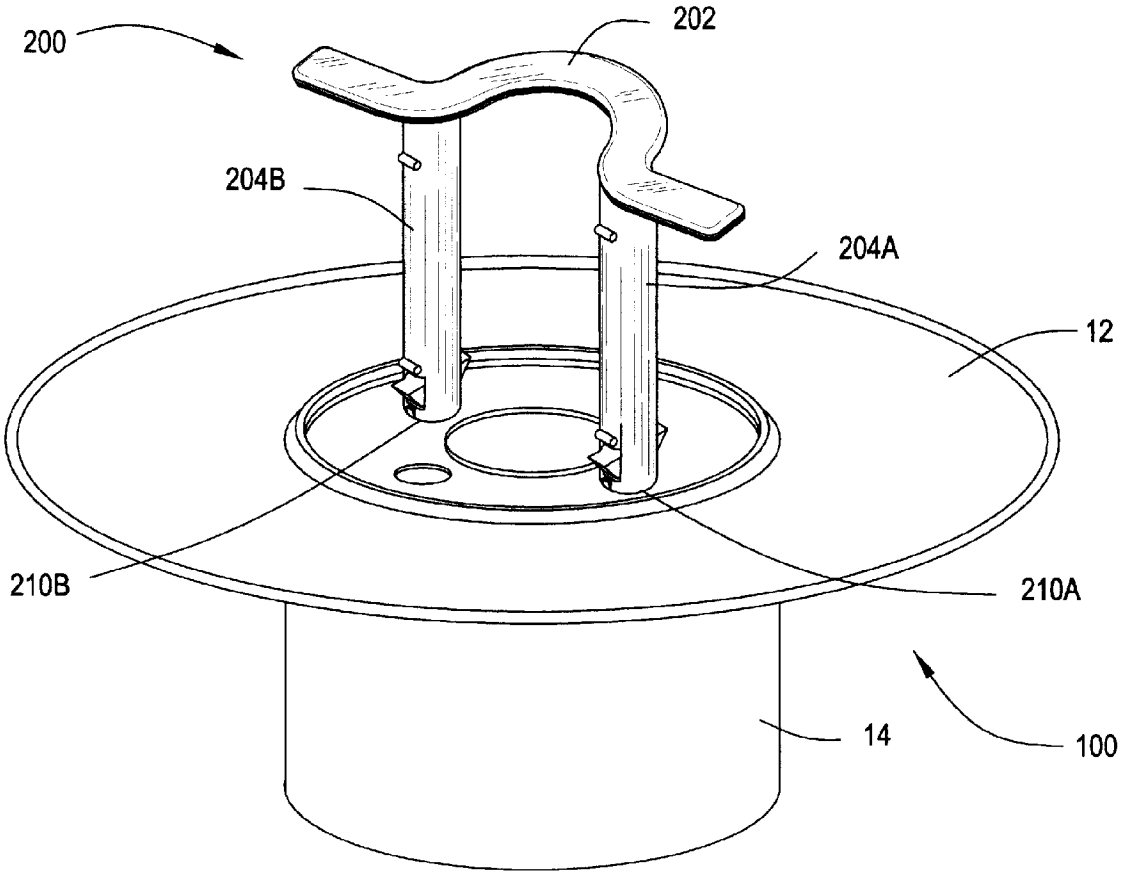
FIG. 7 shows the handle from FIGS. 6A and 6B for the spool of FIGS. 1 and 2.

As shown in FIG. 7, stems 204*a* and 204*b* of handle 200 are inserted into holes 210*a* and 210*b* until the grip portion 200 rests into grip receiving portion 20 as shown for example in FIG. 4C. Clip latches 206*a* and 206*b* may be deformable so as to fit into openings 210*a* and 210*b* in a one way arrangement (when being inserted). In use, a user would simply lift the curved grip portion straight upward until clip latches 206*a* and 206*b* contact an underside of first flange region 12 as shown in FIG. 7. This allows the user to lift spool 100 using the alternative handle 200.

In one arrangement, spool 100 has both openings 19*a* and 19*b* as well as holes 210*a* and 210*b* so that both handles 50 and 200 may be used on the same spool 100.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. A cable carrying assembly comprising:

a spool including a first flange region, drum portion and a second flange region where each of said first flange region, drum portion and said second flange region are integrally molded as a single polymer unit, wherein said drum portion is molded as a hollow drum for supporting a cable said drum having an opening therethrough between said first and second flange regions, wherein said first flange region includes at least two secondary openings and a handle receiving region in the form of a central circular opening delimited by an internal lateral surface, said secondary openings extending perpendicularly to a plane of the first flange region; and a handle, having a continuously curved grip portion, two stems each with a latch knob;

wherein said stems and knobs of said handle are inserted into said at least two openings on said first flange region of said cable carrying assembly to form articulated joints and lock into place via said knobs, such that said grip portion of said handle is arrangeable in a first open position with said grip portion substantially perpendicular to said first flange regions and transversing said opening through said drum between said first and second flange regions and a second closed position with said grip portion folded down about said articulated joints, into said handle receiving region of said first flange region so that a handle plane and said flange region plane are parallel and such that said grip portion of said handle nests against said internal lateral surface of said central circular opening.

2. The spool as claimed in claim 1, wherein said elements of said spool are made of HDPE (High Density PolyEthylene).

* * * * *